US005197760A

United States Patent [19]

Schollenberger

[11] Patent Number: 5,197,760

[45] Date of Patent: Mar. 30, 1993

[54] SKI TYING BAND

[76] Inventor: Peter K. Schollenberger, 2273 Cambridge Ave., Cardiff, Calif. 92007

[21] Appl. No.: 682,466

[22] Filed: Apr. 9, 1991

[51] Int. Cl.[5] ..... A63C 11/02

[52] U.S. Cl. ..... 280/814; 224/917; 280/815

[58] Field of Search ..... 280/814, 815; 224/917

[56] References Cited

U.S. PATENT DOCUMENTS

| | | | |
|---|---|---|---|
| 2,562,178 | 7/1951 | Djos | 280/11.37 |
| 3,626,553 | 12/1971 | Darney et al. | 24/81 SK |
| 3,731,348 | 5/1973 | Luehne | 24/16 PB |
| 3,841,648 | 10/1974 | Meyer | 280/11.37 A |
| 3,947,927 | 4/1976 | Rosenthal | 24/81 SK |
| 3,994,048 | 11/1976 | Rosenthal | 280/814 |
| 4,120,437 | 10/1978 | Hara | 224/45 S |
| 5,022,678 | 6/1991 | Mayfield | 280/814 |

FOREIGN PATENT DOCUMENTS

| | | | |
|---|---|---|---|
| 80383 | 6/1952 | Norway | 280/814 |
| 402697 | 5/1966 | Switzerland | 280/814 |

*Primary Examiner*—Eric D. Culbreth
*Attorney, Agent, or Firm*—Juettner Pyle & Lloyd

[57] ABSTRACT

A ski tying band for binding a pair of skis together in running base to running base relationship for ease in carrying and transporting the skis is comprised of a strap having a loop at one end to be slipped over one end of one ski and a tail to be wrapped around the remaining ski and brought back into engagement with the loop, and cooperative fasteners preferably of the hook and loop fabric type, on the engaging surfaces of the loop and tail for securing the strap about the two skis and binding the skis together with one ply of the loop disposed between and separating the running bases of the skis, thereby to protect the running bases one from the other. Two bands are preferably used, one adjacent each of the opposite ends of the skis to firmly bind them together. In the preferred embodiment, the strap is at least partially elastic so that the loop will elastically grip the one ski and the tail of the strap will elastically bind the remaining ski to the one ski, whereby neither the bands nor the skis will slip or slide relative to one another.

17 Claims, 1 Drawing Sheet

SKI TYING BAND

FIELD OF THE INVENTION

The invention relates to devices for securing a pair of skis together for ease in carrying and transporting the skis.

BACKGROUND

A wide variety of devices have been proposed for securing a pair of skis together in running surface or base to base relationship, with the bases spaced apart so as to avoid damaging the running surfaces of the skis. These devices have taken various forms, such for example s the mechanical devices shown in U.S. Pat. Nos. 2,562,178 and 3,626,553, the flexible belt devices shown in U.S. Pat. Nos. 3,947,927 and 4,120,437, and the simple flexible straps of U.S. Pat. Nos. 3,731,348 and 3,841,648.

The latter two patents disclose relatively inexpensive ties comprised simply of a length of fabric with appropriately located hook and lop fabric fastening means thereon and arranged so that one end of the tie or strap may be inserted between the bases of the two skis and the remainder of the strap may be wrapped around the two skis to hold them together, the hook and loop fastening means being so located as to secure the other end of the strap to the portion of the strap which underlies said other end when the strap is wrapped about the skis. When not being used to tie the skis together, the flexible straps are simply put in the skier's pocket.

The concept is simple and straight forward, but the straps are very difficult to use because the one end of the strap must be manually clamped and held between the skis while the other end is being wrapped around the skis. This requires two hands for use of the strap. Moreover, in cold weather and in the presence of snow and ice, tying of the skis together is difficult to accomplish because the one end of the strap will usually slip out of place before the remainder of the strap can be wrapped around the two skis.

SUMMARY OF THE INVENTION

The object of the present invention is to improve upon the prior art straps, and to provide a ski tying band that is very easy and practical to use.

In accordance with the invention, a loop is permanently formed at one end of the strap so that the loop can be slipped over and encircle one ski, the other ski can be placed against the portion or ply of the loop that is in engagement with the base of the one ski, and the remainder of the strap can be wrapped around the other ski and into engagement with the exposed surface of the other ply of the loop, where it can be secured in place by mating loop and hook fabric fastening means. Because the loop encircles the one ski, it cannot slip or be pulled out of the space between the skis as was the case with the prior art straps, thereby to eliminate the problems occuring in use of the prior art straps.

Further in accord with the invention, the strap or band is preferably formed at least in part of an elastic material and the loop is made slightly smaller than the circumference of the ski so that the loop will elastically grip the one ski and thereby remain in a fixed position on the ski while the remaining ski is placed against the loop and the strap is wrapped around the two skis.

Still further in accord with the invention, the strap or band is preferably formed of a cushioning material that will protect the running surfaces of the skis and prevent them from contacting one another.

These and other objects and advantages of the invention will become apparent from the following detailed description, as considered in conjunction with the accompanying drawings.

DETAILED DESCRIPTION

The following is a detailed description of a preferred embodiment of the invention which is presently contemplated by the inventor to be the best mode of carrying out the invention.

Figure 1:
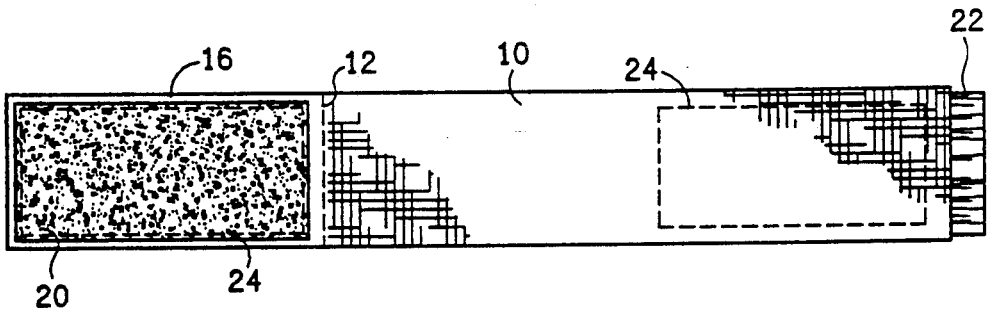
FIG. 1 is a top plan view of a preferred embodiment of the ski tying band of the invention.
Figure 2:
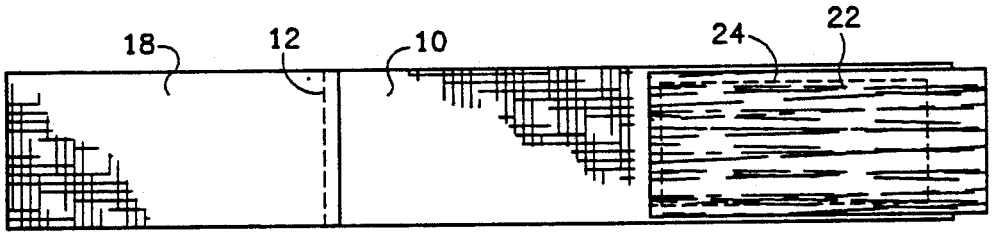
FIG. 2 is a bottom plan view of the band shown in FIG. 1.
Figure 3:
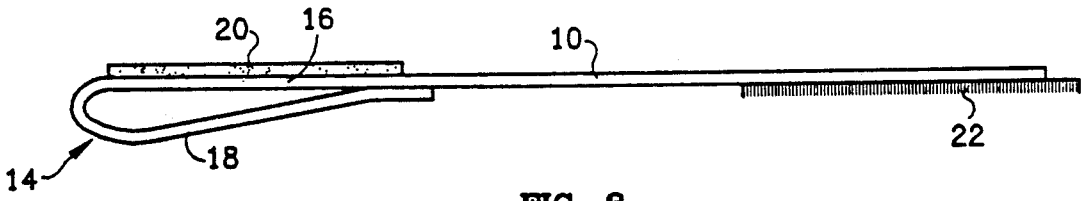
FIG. 3 is a side or edge view of the band of FIGS. 1 and 2.

Referring to FIGS. 1, 2 and 3 of the drawings, the ski tying band of the invention, in its preferred embodiment, is comprised of a unitary piece of material of a length preselected for a particular kind or style of skis, i.e., downhill, cross country or jumping skis. The piece of material is in the form of a strap 10 of an overall effective length approximately equal to four times the sum of the width and thickness dimensions of a typical ski of the selected style or type of ski. Approximately one-half of the strap at one end thereof is folded upon itself, with the said one end thereof being secured, suitably by stitching 12, to approximately the mid point of the length of the strap.

The folded end portion thereby defines a loop 14 formed of approximately one-half of the strap and comprised of two plies 16 and 18, each comprising about one-quarter of the length of the strap 10. The loop therefore is of a size to be slipped over a typical ski of the kind or style selected.

Secured to the exposed surface of one of the plies 16 and 18 is a fastening means 20, which is preferably comprised of a patch of one or the other of a cooperating pair of hook and loop fabric fastening means, such as those sold under the trademark "Velcro". A patch of the other one of the cooperative pair of fastening means, indicated at 22, is secured to the opposite or tail end of the strap 10. The two fastening means are preferably secured to the strap by stitching 24.

In the illustrated embodiment, the fastener 20 is secured to the upper surface of the upper ply 16 of the loop, and the fastener 22 is secured to the opposite or lower surface of the strap. Also, the patch 20 is preferably the loop or plush one of the fasteners, and the patch 22 is the hook fastener. To facilitate separation of the fasteners, the fastener 22 preferably extends beyond the free or tail end of the strap so as to be easily grasped by a user.

Figure 4:
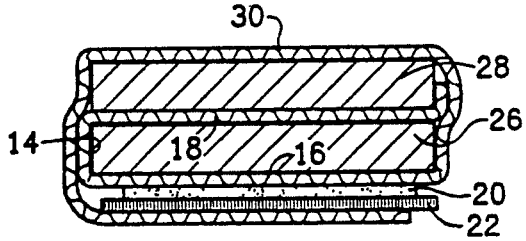
FIG. 4 is a cross sectional illustration of the band in position to tie a pair of skis together.

In use, the loop 14 is slipped over the end of one ski 26 of a pair of skis 26 and 28, thereby to encircle the ski with the fastener bearing ply 16 engaging the upper surface of the ski and the other ply 18 engaging the base of the ski, as indicated illustratively in FIG. 4. The remaining ski 28 is then engaged at its base or running surface with the other side of the ply 18, whereby the ply 18 separates or spaces the skis from one another to prevent injury or damage to their running surfaces.

The tail of the strap is then wrapped around the upper surface of the ski 28, as indicated at 30 in FIG. 4, and is continued around to the upper surface of the ski 26 whereby the two fasteners 20 and 22 are brought into cooperative locking engagement to secure the strap about the skis and to secure the two skis to one another.

It is preferable to use two of the straps or bands, one near the tip ends of the skis and another near the tail ends of the skis, thereby to bind the two sets of ends together in spaced or separated relation. Due the camber found in skis, this provides adequate separation to prevent base damage throughout the full length of the skis. When not in use, the bands are simply stored in the skier's pocket.

The strap 10 may be formed of almost any material desired, provided the material has sufficient flexibility, strength and durability. I prefer to utilize an elastic or semi-elastic material, or to make at least a portion of the loop 14 of elastic material, and to make the loop slightly smaller than the circumference of one ski so that the loop will elastically grip the perimeter of the ski and thereby retain the strap or band in a fixed position on the ski.

It is also preferred to form the strap from a cushioning material thereby to prevent scratching of the skis and also to provide for adequate spacing between the bases of the two skis.

In the preferred embodiment, the strap is formed of neoprene, which is semi-elastic and has a spongy cushioning characteristic. A suitable thickness for purposes of strength, durability and cushioning effect is about 1/8th inch. A suitable width is in the order of from about 1½ inches to about 2 inches.

For currently popular downhill skis, the preferred length of the strap is about 13¼ inches and the internal length of the loop is about three inches. For cross country skis these dimensions would be about 9 inches and about 2 inches, respectively, and for jumping skis about 19 inches and about 4½ inches.

While the strap or band could be fabricated from differing materials, it is preferred to form the same from a single material, e.g., neoprene, as that facilitates and simplifies fabrication and provides a strap or band which combines style, utility and ruggedness. Also, the loop design provides for one hand operation in use of the strap for tying a pair of skis together, and the elastic characteristic of the neoprene causes the straps to grasp the skis and hold them firmly together.

The objects and advantages of the invention have therefore been shown to be achieved in a practical, economical and facile manner.

While a preferred embodiment of the invention has been herein shown and described, it si to be appreciated that various changes, rearrangements and modifications may be made therein without departing from the scope of the invention, as defined by the appended claims.

What is claimed is:

1. A ski tying band for binding together a pair of skis in running base to running base relationship comprising:

a flexible strap having a thickness sufficient to space the running bases of the skis from one another, said strap having an effective length approximately equal to four times the sum of the width and thickness dimensions of one of the skis, a portion of said strap at one end thereof being folded upon itself and having said one end thereof secured to said strap at a location intermediate the ends of said strap, said folded end portion of said strap forming a two ply loop of a size to be slipped over one end of one of the skis, said loop comprising a first ply for engagement with the running base of the one ski and a second ply for engagement with the upper surface of the one ski, said second ply having an inner surface for engagement with the upper surface of the one ski and an outer exposed surface, a first fastening means located on the exposed surface of said second ply, the portion of said strap from said loop to the other end of said strap being adapted to be wrapped tightly about the other one of the skis when the skis are in base to base relationship to bring the other end of said strap into overlying abutting relationship with said first fastening means on the exposed surface of said second ply of said loop, and second fastening means on the surface of said other end of said strap abutting against said first fastening means and cooperative with said first fastening means for securing said other end of said strap to said second ply of said loop for binding the two skis together with said first ply of said loop positioned between and separating the running bases of the two skis.

2. A ski tying band as set forth in claim 1, said strap being comprised of an at least partially elastic material having an overall elastically stretchable effective length approximately equal to four times the sum of the width and thickness dimensions of the one ski.

3. A ski tying band as set forth in claim 1, said fastening means comprising patches of mating hook and loop fabric fastening means secured respectively to said other end of said strap and said second ply of said loop.

4. A ski tying band as set forth in claim 3, the path of fabric fastening means secured to said other end of said strap extending beyond said other end of said strap to facilitate manual grasping of the one path for facilitating release of the one path from the other.

5. A ski tying band as set forth in claim 1, at least said folded end portion of said strap being comprised at least in part of an elastically stretchable material forming said two ply loop of a size to be slipped over and elastically stretched into elastic gripping engagement with the one end of the one ski.

6. A ski tying band for binding together a pair of skis in running base to running base relationship comprising a flexible strap formed of an at least partially elastic material having a thickness sufficient to space the running bases of the skis from one another, said strap having an overall elastically stretchable effective length approximately equal to four times the sum of the width and thickness dimensions of one of the skis, a portion of said strap at one end thereof being folded upon itself and having said one end thereof secured to said strap at a location intermediate the ends of said strap, said folded end portion of said strap forming a two-ply loop of a size to be slipped over and elastically stretched into elastic gripping engagement with one end of one of the skis, said loop comprising a first ply for engagement with the running base of the one ski and a second ply for engagement with the upper surface of the one ski, said second ply having an inner surface for engagement with the upper surface of the one ski and an outer exposed surface, a first fastening means located on the exposed surface of said second ply of said loop, the portion of said strap from said loop to the other end of said strap being adapted to be wrapped about the other one of the skis when the skis are in base to base relationship and being elastically stretchable to elastically grip the other ski and to bring the other end of said strap into overlying abutting relationship with said first fastening means on the exposed surface of said second ply of said loop, and second fastening means on the surface of said other end of said strap abutting against said first fastening means and cooperative with said first fastening means for securing said other end of said strap to said second ply of said loop for elastically binding the two skis together with said first ply of said loop positioned between and separating the running bases of the two skis.

7. A ski tying band as set forth in claim 6, said strap being comprised of semi-elastic neoprene.

8. A ski tying band as set forth in claim 6, said fastening means comprising patches of mating hook and loop fabric fastening means secured respectively to said other end of said strap and said second ply of said loop.

9. A ski tying band for binding together a pair of skis in running base to running base relationship comprising a flexible strap having a thickness sufficient to space the running bases of the skis from one another, said flexible strap including a two ply loop at one end of said strap, said loop being of a size to be slipped over one end portion of one of the skis with one ply of said loop engaging the running base of the one ski and the other ply engaging the upper surface of the one ski, the portion of said strap from said loop to the other end of said strap having an effective length at least approximately equal to the circumferential dimension of the other one of the skis, the portion of said strap from said loop to the other end of said strap being adapted to be wrapped about the corresponding end portion of the other one of the skis when the skis are in base to base relationship to bring said other end of said strap into overlying abutting relationship with said other ply of said loop at the upper surface of the one ski, and cooperative fastening means on the abutting surfaces of said other end of said strap and said other ply of said loop for securing the same together and binding the other one of the skis to the one ski with the running bases of the skis in base to base relationship and separated by said one ply of said loop.

10. A ski tying band as set forth in claim 9, wherein said loop is formed at least in part of an elastic material, is of a size smaller than the circumferential dimensions of the one ski, is elastically stretchable to a size wherein its internal dimensions are at least equal to the circumferential dimensions of the one ski, and is adapted to be slipped over one end portion of the one ski and to be elastically stretched to elastically grip the circumference of the one ski, thereby to retain said loop in a fixed position on the one ski.

11. A ski tying band as set forth in claim 10, wherein said portion of said strap between said loop and said other end of said strap is formed at least in part of an elastic material, is elastically stretchable to a size about equal to the circumferential dimension of the other ski, and is adapted to be elastically stretched around said other ski to elastically bind the other ski to the one ski.

12. A ski tying band as set forth in claim 11, said strap being comprised of a continuous strip of semi-elastic neoprene.

13. A ski tying band as set forth in claim 9, said fastening means comprising patches of mating hook and loop fabric fastening means secured respectively to said other end of said strap and said other ply of said loop.

14. A ski tying band as set forth in claim 13, the patch of fabric fastening means secured to said other end of said strap extending beyond said other end of said strap to permit manual grasping of the same to facilitate manual release of the one patch from the other.

15. A ski tying band as set forth in claim 13, said patches each being stitched to respective ones of said abutting surfaces.

16. A ski tying band as set forth in claim 9, said strap being formed at least in part of an elastic material and having an overall elastically stretchable effective length at least approximately equal to four times the sum or the width and thickness dimensions of the one ski.

17. A ski tying band as set forth in claim 9, said strap being formed of an elastic cushioning material.

* * * * *